US012352137B2

(12) United States Patent
Keerthivasan et al.

(10) Patent No.: US 12,352,137 B2
(45) Date of Patent: Jul. 8, 2025

(54) LINER HANGER RUNNING TOOL

(71) Applicant: National Oilwell Varco Norway AS, Kristiansand S (NO)

(72) Inventors: Vijay Kumar Keerthivasan, Sandnes (NO); Paul David Busengdal, Vestnes (NO); Thorben Linnig, Delmenhorst (DE); Adam Cowan Patterson, Richmond, TX (US)

(73) Assignee: GRANT PRIDECO, INC., Houston, TX (US)

( * ) Notice: Subject to any disclaimer, the term of this patent is extended or adjusted under 35 U.S.C. 154(b) by 295 days.

(21) Appl. No.: 17/707,620

(22) Filed: Mar. 29, 2022

(65) Prior Publication Data

US 2022/0381099 A1 Dec. 1, 2022

(30) Foreign Application Priority Data

May 28, 2021 (EP) ..... 21176610

(51) Int. Cl.
*E21B 43/10* (2006.01)
*E21B 23/08* (2006.01)
*E21B 34/14* (2006.01)

(52) U.S. Cl.
CPC ..... *E21B 43/10* (2013.01); *E21B 23/08* (2013.01); *E21B 34/14* (2013.01)

(58) Field of Classification Search
CPC .. E21B 2200/04; E21B 2200/06; E21B 23/08; E21B 23/10; E21B 34/14
See application file for complete search history.

(56) References Cited

U.S. PATENT DOCUMENTS 3,780,809 A * 12/1973 Ayers, Jr. ..... E21B 34/16 166/374
9,051,810 B1 6/2015 Cuffe et al.
9,353,600 B2 * 5/2016 Cong ..... E21B 23/006
10,920,526 B2 2/2021 Abeidoh et al.
2003/0150620 A1 * 8/2003 DeBerry ..... E21B 33/043 166/88.4
2009/0038796 A1 * 2/2009 King ..... E21B 23/06 166/187
2009/0184278 A1 * 7/2009 Beall ..... E21B 34/14 251/315.1
2010/0319927 A1 12/2010 Yokley et al.
2012/0018172 A1 * 1/2012 Javed ..... E21B 43/10 166/330
2012/0067594 A1 * 3/2012 Noske ..... E21B 47/138 166/373
2015/0136393 A1 * 5/2015 Turley ..... E21B 23/00 166/382

OTHER PUBLICATIONS

European Search Report dated Nov. 15, 2021, for European Application No. 21176610.0 (2 p.).

* cited by examiner

*Primary Examiner* — Blake Michener
(74) *Attorney, Agent, or Firm* — CONLEY ROSE, P.C.

(57) ABSTRACT

Liner hanger running tool (LHRT) having a mandrel with a central through-bore includes a transducer configured to identify a predetermined activation signal and, based on receipt of the predetermined activation signal, transmit an actuation signal. The LHRT also includes a power source. In addition, the LHRT includes a valve. Further, the LHRT includes an actuator configured to be operated by the power source and activated by the actuation signal from the transducer to close the valve in the central through-bore in the mandrel.

23 Claims, 8 Drawing Sheets

11

LINER HANGER RUNNING TOOL

CROSS-REFERENCE TO RELATED APPLICATIONS

This application claims benefit of European patent application No. 21176610.0 filed May 28, 2021, and entitled "Liner Hanger Running Tool," which is hereby incorporated herein by reference in its entirety for all purposes.

STATEMENT REGARDING FEDERALLY SPONSORED RESEARCH OR DEVELOPMENT

Not applicable.

BACKGROUND

The disclosure relates to liner hanger running tool (LHRT). The disclose also relates to a liner hanger assembly (LHA) including an LHRT and to a method for setting a liner hanger (LH) in a well.

A Liner hanger (LH) is a device used to attach and hang liners from the internal wall of a casing string. A liner is similar to a casing, but it does not extend all the way from the top of the well, instead is hung from a lower end of a casing to extend downwardly into the well from there. Conventional liner hangers are run into the well on a running tool string forming part of a drill pipe or work string. Most liners are set hydraulically by dropping a ball from the surface that lands in a ball-seat in a collar at a distance below the liner hanger. Internal pressure in the drill pipe applied from surface acts on a hydraulic piston in the liner hanger above the ball forming a plug in the pipe string. The increased pressure shears one or more shear screws and thereafter moves the LH towards a set position by applying a necessary setting force to set slips to anchor the LH in the casing. The hydraulic setting tool is thereafter released from the LH and the ball-seat is expelled/sheared off by pressuring up further. After the LH is set, the liner is cemented in place in the well.

Conventional hydraulic setting of LHs has several challenges and drawbacks. Some of these drawbacks relate to the need to shear off the ball seat after the LH has been set. If the shear-off pressure (often referred to a "shear pinning") is set too low, this implies that the pressure for setting the LH needs to be set even lower, thereby increasing the risk that the LH may be set pre-maturely due to pressure spikes in the well during circulation. Additionally, it has been observed that shear screws shear at lower values at higher temperatures, which could also lead to pre-mature shearing of the ball seat itself before completing the setting process for the liner hanger. If the shear pinning is set too high, there is a risk of damaging the formation and reducing subsequent well productivity. Too high shear pining could also potentially exceed the pressure ratings for the pipe string and liner hanger assembly (LHA) as such, and also damage other well construction equipment exposed to the pressure.

Further, waiting for a ball to reach a ball seat deep into the well may take significant time. There is also a risk of the ball getting stuck on the way, implying that a second ball may need to be dropped into the well. There is also a risk that a ball will not seal properly against a ball seat, e.g. due to build-up of debris on the seat prior to arrival of the ball and/or because of partial or full wash-out of the seat, and/or because of damaged seals/O-rings on the seat.

SUMMARY

Embodiments described herein offer the potential to remedy or to reduce at least one of the drawbacks of the prior art, or at least provide a useful alternative to prior art.

The object is achieved through features, which are specified in the description below and in the claims that follow. The embodiments are defined by the independent patent claims. The dependent claims define further advantageous embodiments.

In a first aspect, embodiments disclosed herein relate to a liner hanger running tool (LHRT) having a mandrel with a central through-bore, the LHRT comprising: a transducer configured to identify a predetermined activation signal and, based on receipt of the predetermined activation signal, transmit an actuation signal; a power source; a valve; and an actuator configured to be operated by the power source and activatable by the actuation signal from the transducer to close the valve in the central through-bore in the mandrel.

As an alternative to a transducer, it is also possible to close the valve mechanically, such as via a j-slot arrangement and a spring system. J-slot mechanisms have been used as mechanical counter systems in the past in several downhole tools, such as disclosed in U.S. Pat. No. 9,353,600B2. The mechanism includes a profile on a sleeve and a key on an outer or inner sleeve. The sleeve containing the key has a spring acting against the direction of the pressure-induced force. As pressure cycles from a low value to a high value and back to a low value (defined as a pressure cycle), the key travels through the profiles. After a pre-set number of cycles, there is an exit point from the cycle, which then allows a sleeve to linearly actuate due to the spring force. In this specific case, the linear actuation may then be used to open a valve, such as a ball-valve, in the LHRT.

In one embodiment, the power source may include a battery and/or one or more capacitors. An electronic accumulator, such as a battery or a capacitor, may ensure a quick and reliable release of energy to the actuator. Since, in most operations, the/each actuator only needs to be operated once, there is no need to charge the accumulator. This also implies that the size of batteries and/or capacitors may be limited, making it easier to fit it into the LHRT, typically in a cavity in the mandrel. In one embodiment, the power source may, as an addition or alternative, include a mechanical, hydraulic or pneumatic accumulator, where potential energy, such as from a compressed spring fluid or fluid, may be released to drive the actuator.

In one embodiment, the transducer may be a pressure transducer configured to identify a predetermined activation signal in the form of a pressure signature in the central through-bore in the mandrel of the LHRT. An advantage of this is that no designated connection needs to be made to topside, such as wiring the drill pipe etc, for transfer of the signal. The sensitivity of modern pressure transducers is also so that there is no need to pressure up the pipe string to a level at which there is any risk of unintentional shearing of shear screws etc while maintaining high fluid circulation rates. In an alternative embodiment, the predetermined activation signal may be an acoustic signal sent via the pipe string, or the predetermined signal may be an electric or optic signal sent via wire from topside. The pressure signature may be a pulse signature super-imposed on the base pressure or the pressure signature may be a predetermined sequence of base pressures as will be exemplified below.

In one embodiment, the LHRT may further comprise a setting sleeve disposed outside the mandrel, the setting sleeve being linearly movable relative to the mandrel in response to pressure in the central through-bore of the LHRT. It should be noted that when referring to a "setting sleeve" herein, is meant the sleeve on the LHRT, and it should not be confused with setting positions on the LH as such, which are also sometimes referred to as "setting sleeves" in the literature. A setting sleeve may provide a reliable and robust way of controlling the setting process of the LH, such as for controlling when the LH setting piston is exposed to a hydraulic pressure in the pipe string. In a one embodiment, the valve may be a ball valve mechanically connected to the setting sleeve, whereby moving the setting sleeve in a first direction closes the valve. Similarly, moving the setting sleeve in the opposite direction may then subsequently open the valve again. Connecting the sleeve mechanically to the ball valve in such a way that the valve element (i.e.) the ball is rotated upon linear motion of the setting sleeve provides a particularly simple and reliable solution for setting the LH. In an alternative embodiment the valve may be a flapper valve that is able to hold pressure from above when closed. The flapper valve may be closed by the linear actuation of the setting sleeve and thus, hold pressure from above to provide a plug to set the LH against. Flapper valve designs used in safety valves are designed to hold pressure from below but when used in aspects of embodiments described herein the valve may be flipped to have the flapper valve hold pressure from above to provide a barrier/plug to set the LH.

In one embodiment, activation of the actuator may open a radial bore in the mandrel hydraulically connecting the setting sleeve and the central through-bore of the mandrel so that one side of a shoulder on the setting sleeve is exposed to the hydraulic pressure in the through-bore. The shoulder may thereby be acting as a piston for driving the setting sleeve in one direction. The setting sleeve, prior to opening the radial bore in the mandrel, can substantially pressure balance, meaning that no substantial pressure differential and hence no substantial net force is working on the setting sleeve. The actuator may be a liner actuator provided with a cutting device, such as a knife or another sharp object at its distal end, configured to move linearly from a retracted position to an extended position in which the cutting device cuts/shears/punctures an object that was blocking the radial bore. The object may typically be a shear plug or a burst disc.

In one embodiment, the transducer may be first transducer for identifying a first predetermined activation signal and to transmit a first actuation signal; and the actuator may be a first actuator, and wherein the LHRT may further include: a second transducer configured to identify a second predetermined activation signal and, based on receipt of the second predetermined activation signal, transmit a second actuation signal; and a second actuator operable by means of a power source and activatable by means of the second actuation signal from the second transducer to open the valve in the central through-bore in the mandrel. It may the same power source powering the first actuator, or it may be a separate power source. If it is a separate power source, it may typically be of the same type as the first power source.

In one embodiment, where the first actuator opens a radial bore in the mandrel, the radial bore in the mandrel may be a first radial bore and the shoulder on the sleeve may be a first shoulder with a first contact area; and wherein activation of the second actuator may open a second radial bore in the mandrel hydraulically connecting the setting sleeve and the central through-bore so that one side of a second shoulder on the setting sleeve may also be exposed to the hydraulic pressure in the through-bore, the second shoulder having a second contact area which is larger than the first contact area of the first shoulder. By letting the same pressure act on different sides (i.e. one on an upstream or left side and the other on a downstream or right side) of two shoulders/pistons with unequal contact areas, and net force may be obtained to counteract the effect of the first shoulder/piston moving the setting sleeve in a first direction. This implies that a similar procedure, i.e. with a second unique activation signal, may also be used to drive the setting sleeve in an opposite direction to open the valve in the mandrel after it being closed.

In one embodiment the LHRT can be provided with first burst disc and optionally a second burst disc, wherein the burst disc(s) is/are placed in (an) additional radial bore(s) providing alternative, hydraulic connection(s) between the central through-bore in the mandrel and the first, and optionally second, shoulder(s) on the setting sleeve. In case the one or two actuators do not work as intended, the pressure may be increased in the pipe string (and thereby in the central through-bore of the LHRT mandrel to puncture a burst disc to obtain an alternative "route" for the hydraulic connection between the through-bore and the cavity near the first and/or second shoulder on the setting sleeve. The first burst disc(s) may be exposed to the well pressure on one side and an atmospheric pressure on the other side, whereby an absolute well pressure will be decisive for the necessary rupture pressure. If two such burst discs are provided, then the burst disc providing back-up for the first actuator should preferably have a lower bursting pressure that the second burst disc providing back-up for the second actuator.

In a second aspect, embodiments disclosed herein relate to a liner hanger assembly (LHA) including a LHRT according to the first aspect, and the LHA further comprising: a linger hanger (LH) connected to the LHRT, the LH being formed with a setting port and comprising a setting piston and an anchor, the setting piston being operable by hydraulic pressure through the setting port to set the anchor inside a casing in a well. In one embodiment, the LHRT may be provided with a pair of seals straddling the setting port on the LH prior to activating the (first) actuator, thereby reducing the risk of unintentional setting of the LH.

In a third aspect, embodiments disclosed herein relate to a method for installing a LH by means of a LHA according to the second aspect, and the method including the steps of: connecting the LHA to a liner; running the liner with the LHA into a well on a pipe string, the pipe string being in fluid connection with the through-bore of the LHRT; positioning the LH inside a casing to which it is to be connected; transmitting a (first) predetermined activation signal to the (first) transducer to activate closing of the valve by means of the first actuator; increasing the pressure in the pipe string above the closed valve; exposing the setting piston on the LH to the pressure in the pipe string through the setting port to set the anchor inside the casing and thereby connect the LH to the inside of the casing.

In one embodiment, the method may further include the step verifying that the LH has been set by controlling the weight on the pipe string. Once the LH is properly set inside the casing, the casing will carry the weight of the liner.

The method may further include the step of further increasing the pressure in the pipe string to release the LHRT from the LH. This may include moving the LHRT in the LH system by pulling or pushing the LHRT to ensure a proper release. Further the method may include increasing the pressure to open/close/activate other parts of the LHRT such as hydraulic packer actuators, hydraulic open/close valves, etc.

The method may further also include the step of: transmitting a second predetermined activation signal to a second transducer to activate opening of the valve by means of second actuator. The LHRT may then be pulled out of the well with the pipe string.

To summarise, various embodiments disclosed herein provide one or more of the following advantages:

- Prevent premature setting of liner hanger while allowing very high circulation pressures and rates during run-in-hole. This feature eliminates, or at least significantly reduces, the possibility of the liner hanger getting prematurely set due to unexpected surges in well pressures. Activation pressure sequence can be at low pressure with discrete signal or time delay.
- There is no need to shear out a ball seat, thereby no need for pressure levels at which there is a risk of damaging the formation. The fact that the valve is positioned in the LHRT also ensures that increased pressures is kept at a large distance from the formation.
- The LHRT includes all the necessary components to activate and set the LH, significantly simplifying retrofitting to existing liner hanger systems.
- Activation pressure of other liner accessories pre and post LH setting can be flexible. Higher circulation rates, especially when running the LH into the hole.
- No need to wait for setting ball to reach ball seat, thereby reducing rig time especially in horizontal well operations.

BRIEF DESCRIPTION OF THE DRAWINGS

In the following is described an example of an embodiment illustrated in the accompanying drawings, wherein.

DETAILED DESCRIPTION

Figure 1:
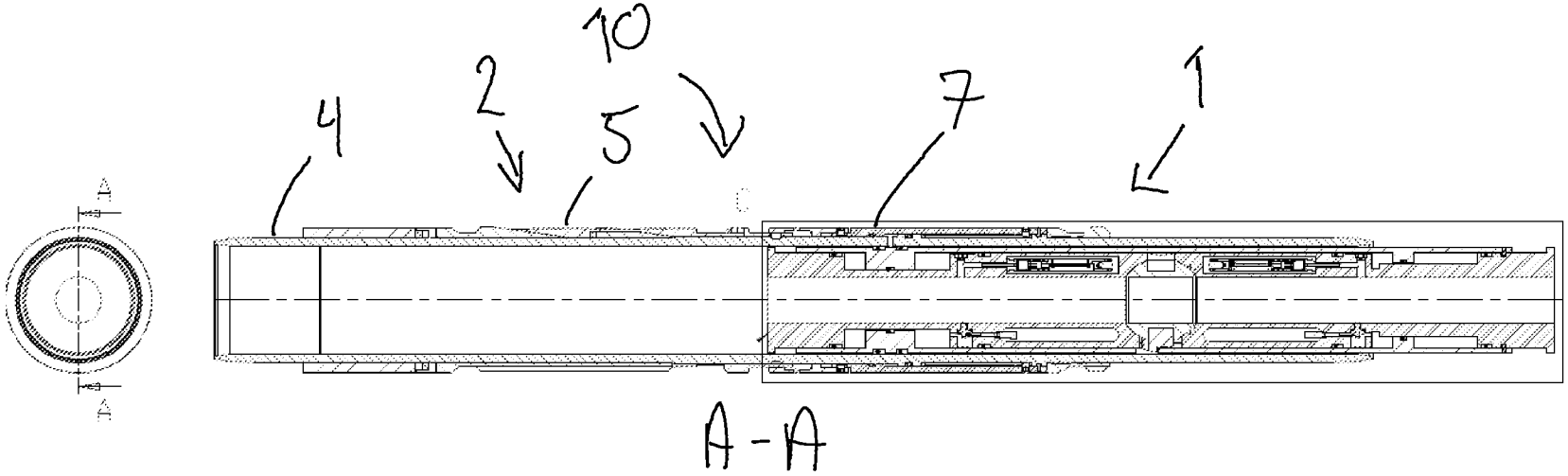
FIG. 1 shows an embodiment of a liner hanger assembly in accordance with principles described herein in a first operational mode.

In the following the reference numeral 1 will be used to denote an embodiment of a liner hanger running tool (LHRT) according to the first aspect, whereas reference numeral 10 will be used to denote an embodiment of a liner hanger assembly (LHA) according to the second aspect. Identical reference numerals will refer to identical or similar features in the drawings. Various features in the drawings are not necessarily drawn to scale.

Figure 2:
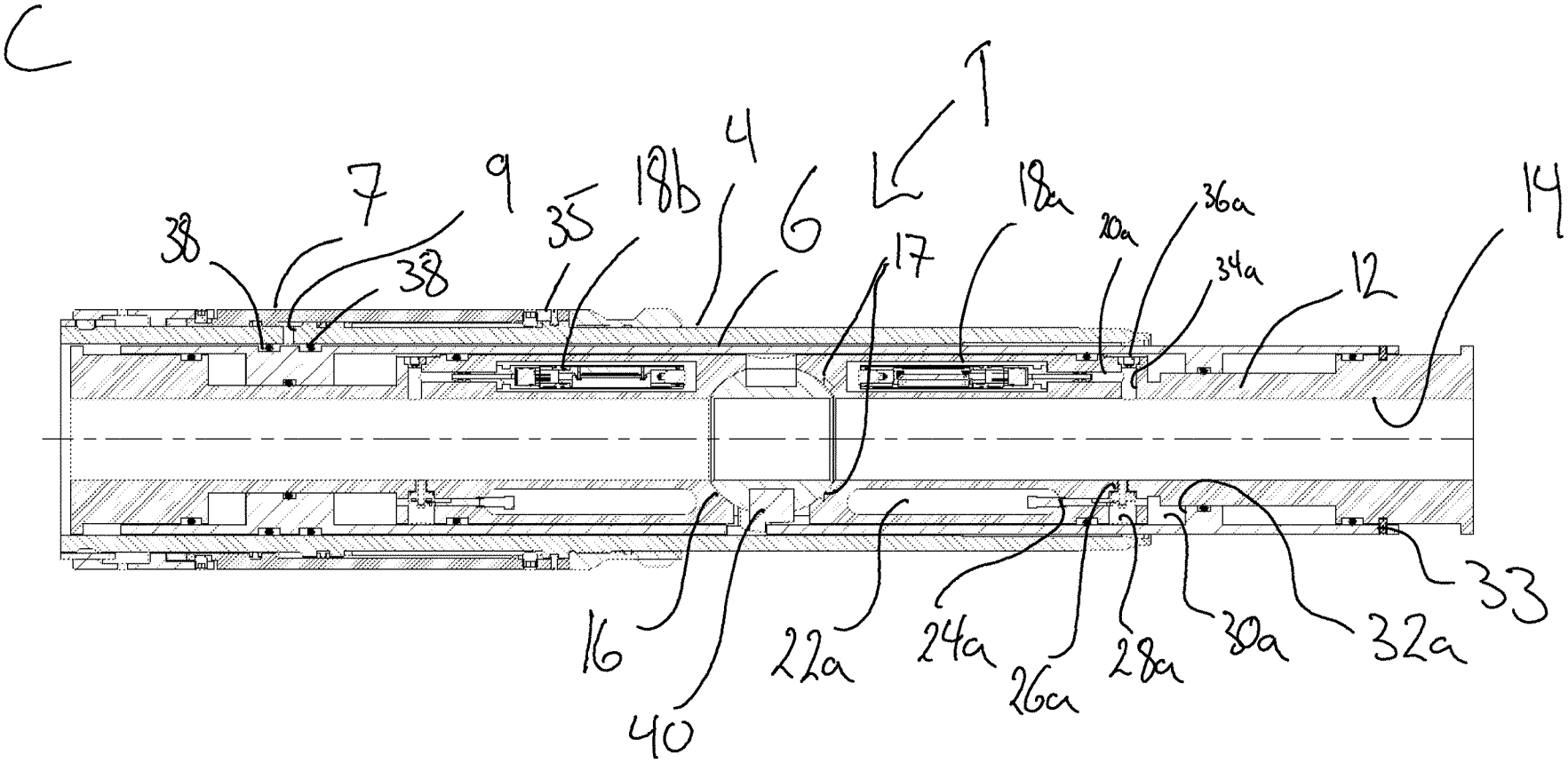
FIG. 2 shows an enlarged detail from FIG. 1.

FIG. 1 shows an embodiment of an LHA 10 in a longitudinal cross-section through the line A-A as shown in the side view to the left. FIG. 2 shows detail C, including the LRHT 1 as included in the LHA 10, in an enlarged view.

The LHA 10 assembly includes a linger hanger (LH) 2 that is to be set inside a casing (not shown) in a well, where the LH 2 is arranged on the outside of a pipe mandrel 4, the pipe mandrel 4 forming a part of a liner. The LH further includes a set of slips 5 outside the pipe mandrel 4 to be radially expanded to anchor LH inside the casing, to extend the casing further into the well by means of the liner. The LH 2 is hydraulically operable by a means of a setting piston 7 hydraulically accessible via a setting port 9 forming a radial hole in the pipe mandrel 4 as will be explained in more detail below. The LH 2 is connected to and run into a well on the LHRT 1 such that the LHRT 1 is arranged inside the pipe mandrel 4. A setting sleeve 6 of the LHRT 1 is arranged between the pipe mandrel 4 and a LHRT mandrel 12. The LHRT mandrel 12 is formed with a central through-bore 14, and a ball valve 16 is arranged in the through-bore 14, mechanically connected to the setting sleeve 6, as will be explained below. In FIGS. 1 and 2, the LHA 10 is in an un-activated state, and the ball valve 16 is open allowing circulation of fluids therethrough. When running the LHA into the hole/well, the LHA 10 will be in this state.

The LHRT 1 is, in the shown embodiment, provided with a two transducers in the form of a first pressure transducer 18*a* and a second pressure transducer 18*b*. The first pressure transducer 18*a* is provided below/downstream of the ball valve 16 inside a cavity of the LHRT mandrel 12. The first pressure transducer 18*a* is in fluid communication with the central through-bore 14 of the LHRT 1 through a first opening/communication port 20*a* in the LHRT mandrel 12. The first pressure transducer 18*a*, being in fluid communication the whole pipe string on which the LHA 10 is run, is configured to recognize a predetermined activation signal in the form of a first unique pressure pulse signature in the fluid present in the central through-bore 14. Upon receipt of such a unique pressure pulse signature, the first transducer 18*a* sends an actuation signal to a first actuator 22*a* to start an actuation sequence. The first actuator 22*a*, which in this shown embodiment includes a knife 24*a*, is also located in a cavity in the LHRT mandrel 12 together with a power source in the form of a not shown battery and/or capacitor and not a shown control unit for activating the first actuator 22*a* based on the received actuation signal from the first transducer 18*a*. The first actuator 22*a* forces the knife 24*a* linearly downwardly in the length direction of the LHRT mandrel 12 to shear off a first shear plug 26*a* provided in a first radial bore 28*a* of the LHRT mandrel 12. Puncturing the first shear plug 26*a* opens a hydraulic connection between the central through-bore 14 of the LHRT 1 and a cavity 30*a* provided outside the setting sleeve, at a first shoulder portion 32*a* of the setting sleeve 6 as will discussed more in detail with reference to the following drawings. Before shearing off the first shear plug 26*a*, the setting sleeve is pressure balanced in the sense that no or very little differential pressure is acting on the setting sleeve 6. To safeguard that the setting sleeve 6 does not move unintendedly, the setting sleeve is connected to the LHRT mandrel 12 by means of a shear screw 33 intended to shear at predetermined shear force as will be explained below. As a contingency, the LHRT 1 also includes a first back-up radial bore 34*a* connected with the communication port 20*a* and provided with a first burst disc 36*a*. In a situation where the first transducer 18*a* and/or the first actuator 22*a* do not work and/or where the first shear plug 26*a* does not shear properly, the first burst disc 36*a* made be broken at a predetermined pressure to open a back-up route to the first cavity 30*a*. The first burst disc 36*a* (as well as the second burst disc 36*b*, as will be discussed below) is exposed to the well pressure on one side and an atmospheric pressure on the other side. The burst discs 36*a, b* will therefore rupture at different predetermined absolute pressures in the well. Rupturing the burst disc 36*a* provides an alternative/back-up hydraulic connection between the central through bore 14 and the first cavity 30*a*.

When an operator, or an autonomous control system, decides to activate setting of the LH 2, the first unique pressure pulse signature is generated from topside. Mud pulse telemetry and the general principles of transferring signals via mud or other wellbore fluids, both up and down a well, is known from different fields of petroleum technology and will be understood by a person skilled in the art. The first pressure transducer 18*a* recognises the first unique pressure pulse signature and sends the actuation signal to the first actuator 22*a* as explained above. It should also be noted that the activation signal does not need to be a pulse super-imposed on the base pressure, but that it could simply also be an absolute pressure profile changing over time. As an example, an operator may keep the pressure level in the well at X psi for 10 mins, Y psi for 5 mins, Z psi for 8 mins and back to X psi for 10 mins.

Figure 3:
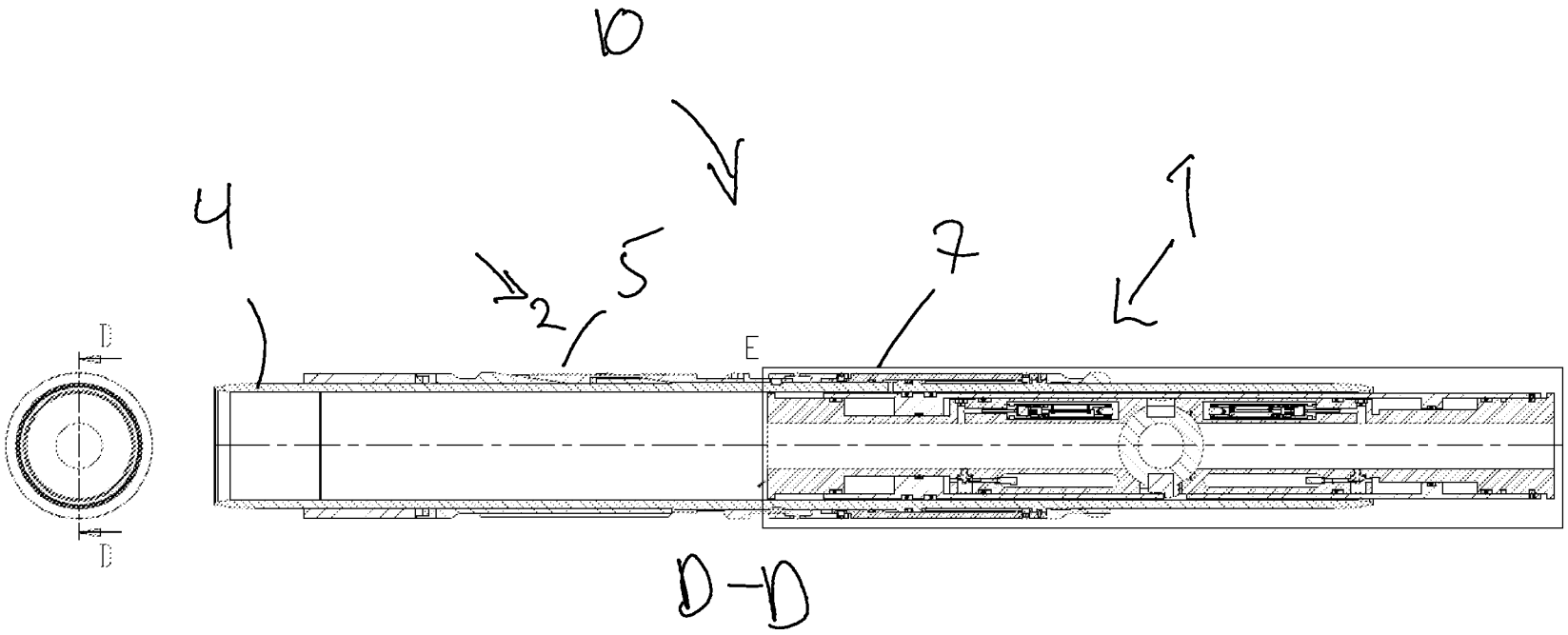
FIG. 3 shows the liner hanger assembly from FIG. 1 in a second operational mode.
Figure 4:
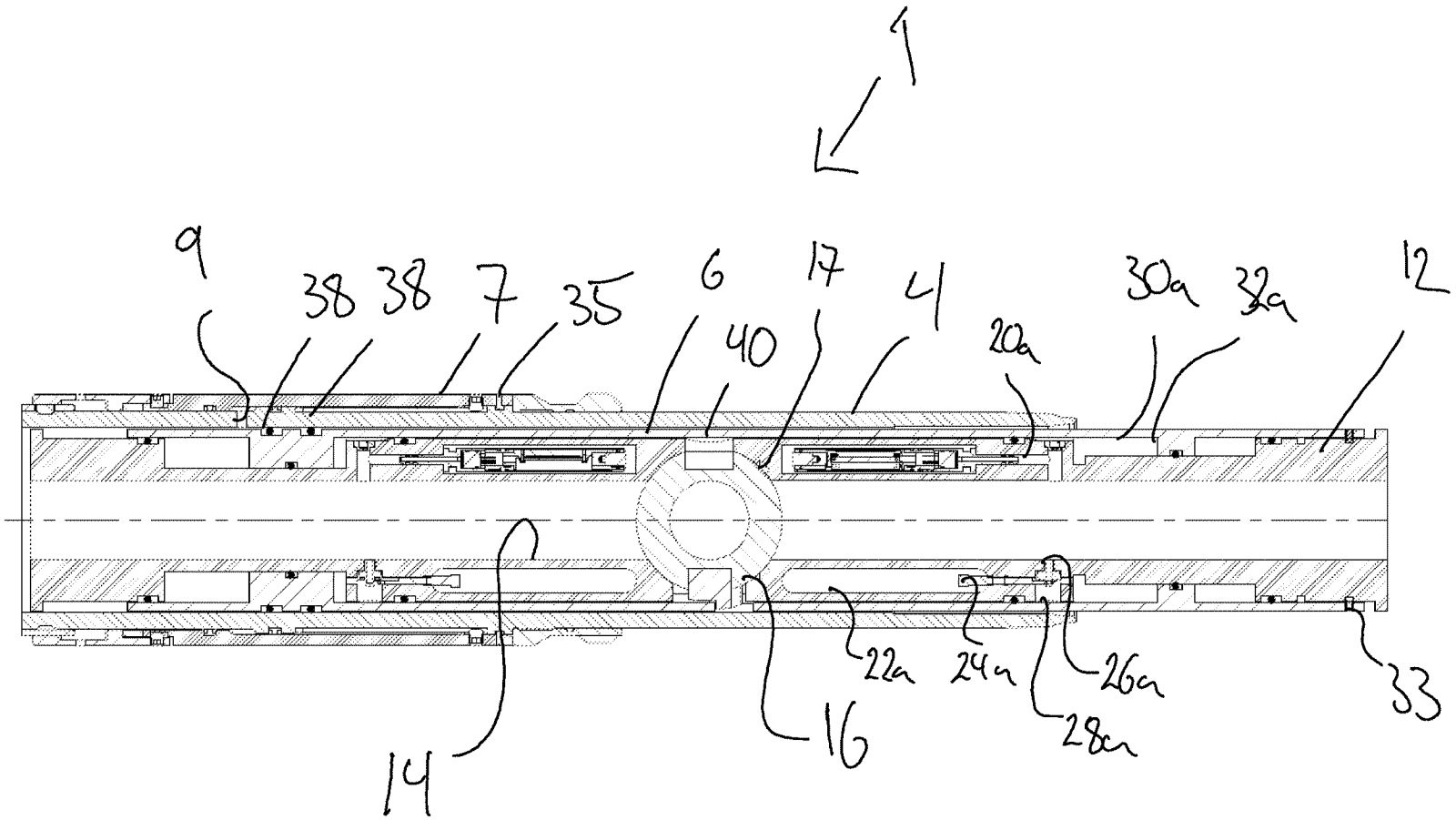
FIG. 4 shows an enlarged detail from FIG. 3.

FIG. 3 shows the LHA 10 in a longitudinal cross-section through the line D-D as shown in the side view to the left. FIG. 4 shows detail E, including the LRHT 1 as included in the LHA 10, in an enlarged view. FIGS. 3 and 4 show the LHA 10 and LHRT 1 after the first shear plug 26*a* has been punctured and thereby opening a hydraulic connection between the central through-bore 14 of the LHRT 1 and the cavity 30*a* provided outside the setting sleeve 6 at the first shoulder portion 32*a* as explained above. The first shoulder portion 32*a* is thereby exposed to the hydraulic pressure in the pipe string and the central through bore 14 in the LHRT 1, whereby a net force is acting on the setting sleeve 6 to push the first shoulder 32*a*, in principle acting like a piston, downwardly in the length direction of the LHRT mandrel 12, i.e. to the right in the drawing. The force acting on the setting sleeve 6 also shears the shear screw 33. Before the setting sleeve 6 is forced to the right, i.e. as shown in FIGS. 1 and 2, two seals 38 straddle the setting port 9 in the pipe mandrel 4 thus preventing hydraulic fluid from entering the setting port 9. In the shown embodiment, the setting sleeve is mechanically connected to the ball valve 16 so that moving the setting sleeve 6 to the right, as shown in FIGS. 3 and 4, at the same time closes the ball valve 16 and thereby the central through-bore 14. Seals 17 seal between the valve element of the ball valve 16 and the LHRT mandrel 12. In the shown embodiment, the rotatable valve element of the ball valve 16 is connected to the setting sleeve by means of lugs 40 which, upon contact with the linearly moving setting sleeve 6, rotate to close the ball valve 16. Moving the setting sleeve 6 thus has the double function of closing the ball valve 16 and moving the seals 38 away from the straddling position around the setting port 9 in the pipe mandrel 4 to expose the setting port 9. The setting piston 7 on the LH 2 is thereby exposed to the pressure in the pipe string and the central through-bore above/upstream of the closed ball valve 16 through the setting port 9.

Figure 5:
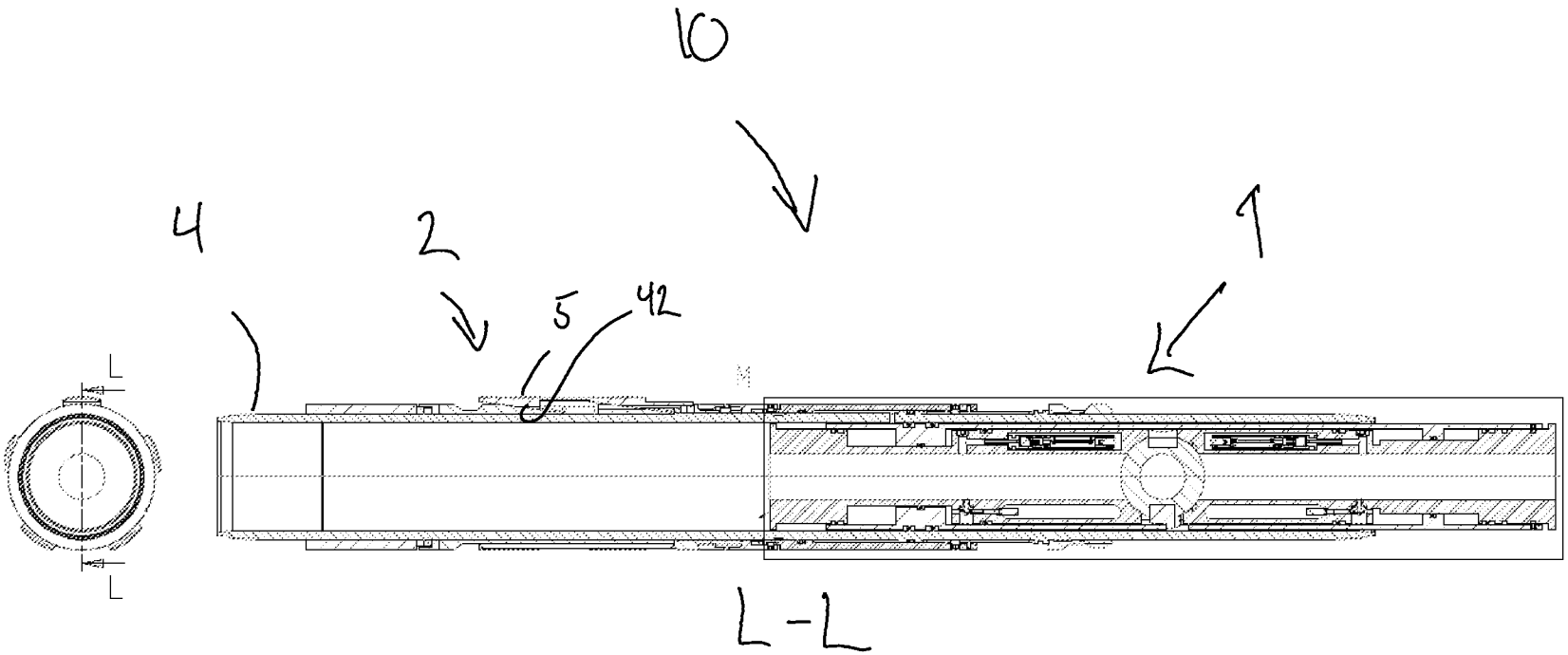
FIG. 5 shows the liner hanger assembly from FIG. 1 in a third operational mode.
Figure 6:
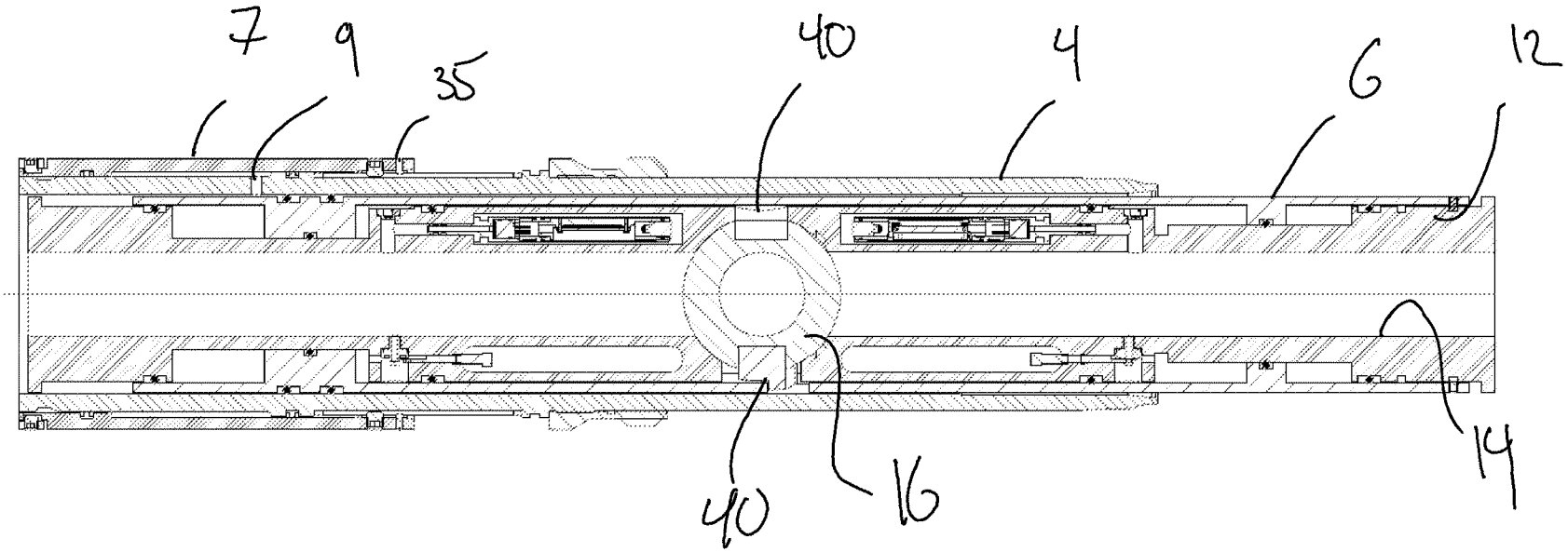
FIG. 6 shows an enlarged detail from FIG. 5.

FIG. 5 shows the LHA 10 in a longitudinal cross-section through the line L-L as shown in the side view to the left. FIG. 6 shows detail M, including the LRHT 1 as included in the LHA 10, in an enlarged view. At this stage the setting operation, the pipe string has been pressured up to a first pre-determined pressure, typically in the order of 1800 psi (124 bar), where the setting piston 7 is forced upwardly in the length direction of the LHRT 1, i.e. to the left in the drawings, as shown in FIGS. 5 and 6. Before the setting piston is set in motion by the pressure in the pipe string, it is connected to the outside of the pipe mandrel by means of a shear screw 35, intended to shear at a predetermined shear force. The setting piston 7, after shearing the shear screw 35, pushes the slips 5 over a wedged/oblique surface 42 on the LH 2 to force the slips 5 radially outwards against the inside of the not shown casing to anchor the LH 2 inside casing. At this stage, the operator typically controls the weight of the pipe string from topside to verify that the LH has been properly set, i.e. to verify that the weight has been reduced on the pipe string since the casing is now carrying the LH 2 and liner. Further, after verifying that the LH 2 has been properly set, the pipe string is typically pressured up to a second predetermined pressure, typically in the order to 2000 psi (138 bar) or higher, to release the LHRT 1 from the LH 1

Figure 7:
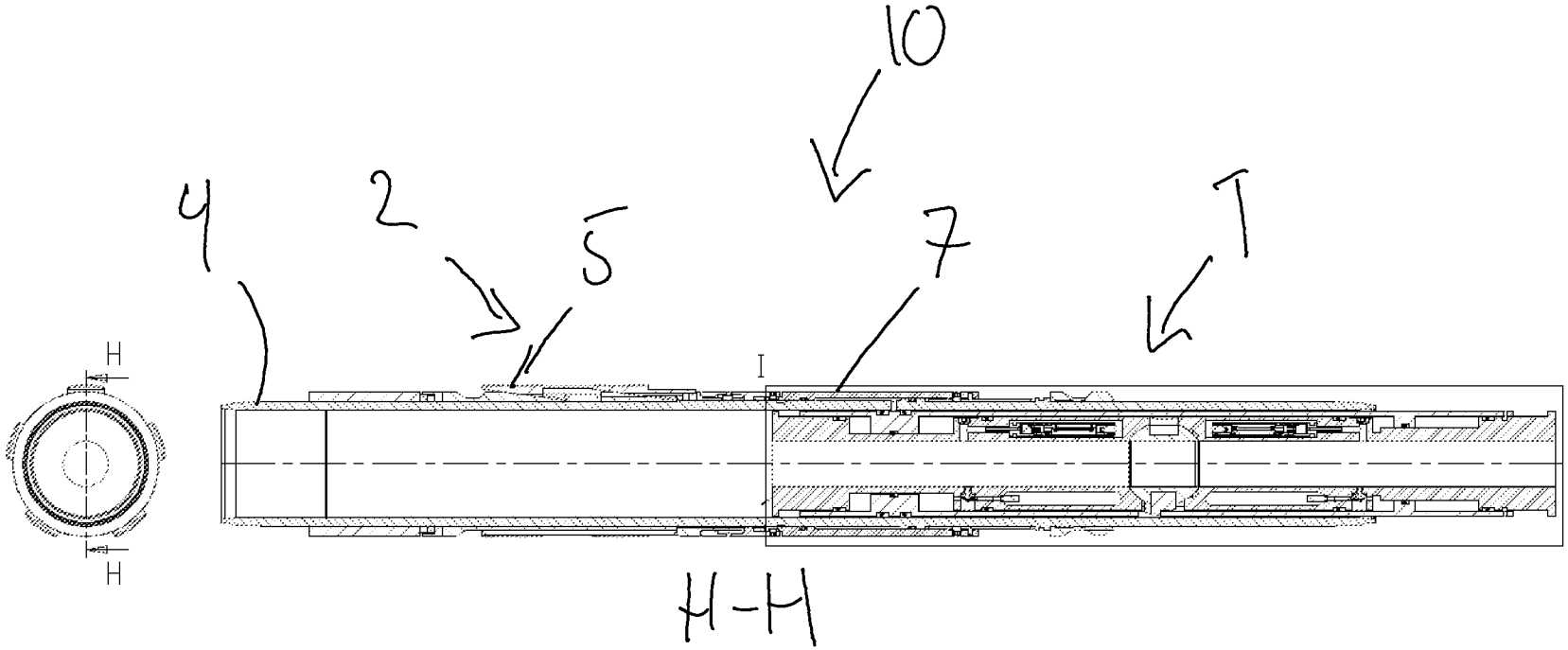
FIG. 7 shows the liner hanger assembly from FIG. 1 in a fourth operational mode.
Figure 8:
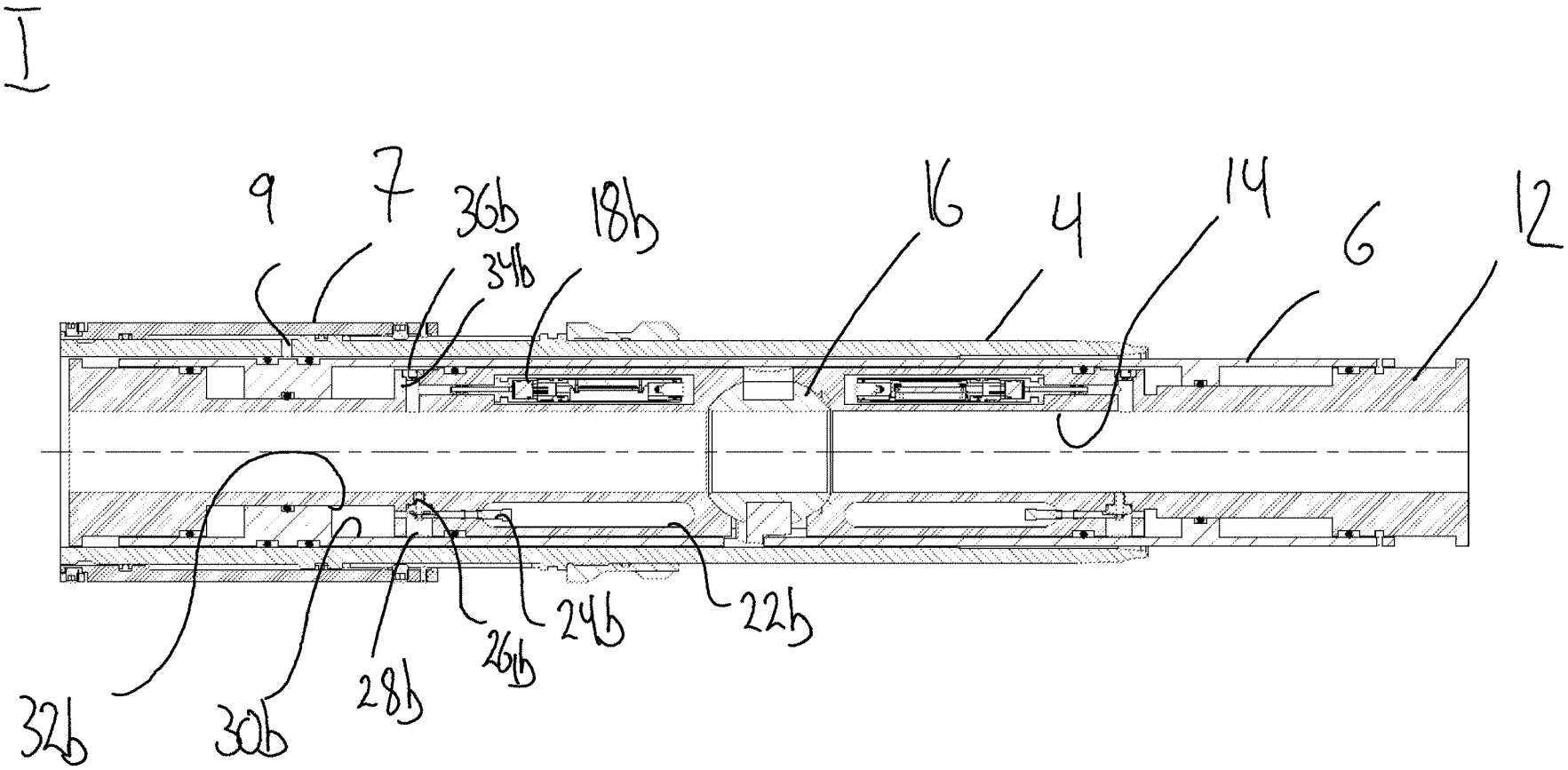
FIG. 8 shows an enlarged detail from FIG. 7.

FIG. 7 shows the LHA 10 in a longitudinal cross-section through the line H-H as indicated in the side view to the left. FIG. 8 shows detail I, including the LRHT 1 as included in the LHA 10, in an enlarged view. After the LH 2 has been properly set and the LHRT 1 has been released from the LH 2, a second unique pressure pulse signature is sent from topside to be identified by the second pressure transducer 18*b*, which is in hydraulic communication with the through-bore 14 via a second communication port 20*b*. The second pressure transducer 18*b*, upon receipt of the second unique pressure pulse signature, activates a second actuator 22*b*, including a second not shown battery and/or capacitor and control unit. The second actuator 22*b* includes a second knife 24*b* which is forced linearly upwardly by the actuator 22*b* in the length direction of the LHRT mandrel 12, i.e. to the left in the drawings, to puncture a second shear plug 26*b*. The puncturing opens a hydraulic connection between the inside of the through-bore 14 and a second cavity 30*b* outside the setting sleeve in which the pressure from the through-bore acts on a second shoulder portion 32*b* of the setting sleeve, in effect acting as a second piston. The second shoulder portion 32*b* has a larger contact area for the hydraulic fluid than the corresponding first shoulder portion 32*a*. Since the same pressure in the central through-bore 14 now acts on opposite sides of the shoulder portions, i.e. on the left side of the first shoulder portion 32*a* and on the right side of the second shoulder portion 32*b*, and since the second shoulder portion has a larger contact area, a net upward force pushes the setting sleeve 6 in the length direction of the LHRT mandrel 12, i.e. to the left in the drawings, back to its initial position. The linear motion of the setting sleeve 6 now acts to rotate the valve element of the ball valve 16 in an opposite direction to open the ball valve 16. The LHRT 1 may now be pulled out of the well. A second burst disc 36*b* in a second/back-up radial bore 34*b* is provided for similar contingency reasons as described above.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage.

What is claimed is:

1. A liner hanger running tool (LHRT) for running a liner hanger (LH) into a well and setting the LH in the well, wherein the LH includes a plurality of slips, each slip having a retracted position and an expanded position, the LHRT comprising:

a mandrel with a central through-bore;

a transducer configured to identify a predetermined activation signal and, based on receipt of the predetermined activation signal, transmit an actuation signal;

a power source;

a valve disposed along the central through-bore of the mandrel, wherein the valve has an open position configured to allow a flow of a fluid through the central through-bore of the mandrel and a closed position configured to prevent the flow of the fluid through the mandrel; and an actuator configured to be operated by the power source and activated by the actuation signal from the transducer to transition the valve from the open position to the closed position;

wherein the LHRT includes:

a running position coupled to the LH and configured to lower the LH into the well valve in the open position and the plurality of slips of the LH in the retracted positions; and a setting position coupled the LH and configured to transition the plurality of slips of the LH from the retracted positions to the expanded positions to set the LH in the well in response to transition of the valve from the open position to the closed position.

2. The LHRT of claim 1, wherein the power source includes a battery.

3. The LHRT of claim 1, wherein the transducer is a pressure transducer configured to identify a predetermined activation signal in the form of a pressure signature in the central through-bore of the LHRT.

4. The LHRT of claim 1, wherein the LHRT further comprises a setting sleeve disposed outside the mandrel, wherein the setting sleeve is linearly movable relative to the mandrel in response to pressure in the central through-bore of the LHRT.

5. The LHRT of claim 4, wherein the valve is a ball valve mechanically coupled to the setting sleeve, whereby moving the setting sleeve in a first direction closes the valve.

6. The LHRT of claim 4, wherein activation of the actuator is configured to open a radial bore in the mandrel hydraulically coupling the setting sleeve and the central through-bore so that one side of a shoulder on the setting sleeve is exposed to the hydraulic pressure in the through-bore.

7. The LHRT of claim 5, wherein activation of the actuator is configured to open a radial bore in the mandrel hydraulically coupling the setting sleeve and the central through-bore so that one side of a shoulder on the setting sleeve is exposed to the hydraulic pressure in the through-bore.

8. The LHRT of claim 7, wherein:

the transducer is a first transducer for identifying a first predetermined activation signal and to transmit a first actuation signal; and the actuator is a first actuator, and wherein the LHRT further includes:

a second transducer configured to identify a second predetermined activation signal and, based on receipt of the second predetermined activation signal, transmit a second actuation signal; and a second actuator operable by means of a second power source and activatable by means of the second actuation signal from the transducer to open the valve in the central through-bore in the LHRT.

9. The LHRT of claim 8, wherein the radial bore in the mandrel is a first radial bore and the shoulder on the sleeve is a first shoulder with a first contact area; and wherein activation of the second actuator opens a second radial bore in the mandrel hydraulically connecting the setting sleeve and the central through-bore so that one side of a second shoulder on the setting sleeve is also exposed to the hydraulic pressure in the through-bore, the second shoulder having a second contact area which is larger than the first contact area of the first shoulder.

10. The LHRT of claim 9, wherein the LHRT is provided with a first burst disc placed in an additional radial bore to provide a hydraulic connection between the central through-bore and the shoulder on the setting sleeve.

11. The LHRT of claim 10, wherein the LHRT is provided with a second burst disc placed in an additional radial bore to provide a hydraulic connection between the central through-bore and the a second shoulder on the setting sleeve.

12. The LHRT of claim 1, wherein:

the transducer is a first transducer for identifying a first predetermined activation signal and to transmit a first actuation signal; and the actuator is a first actuator, and wherein the LHRT further includes:

a second transducer configured to identify a second predetermined activation signal and, based on receipt of the second predetermined activation signal, transmit a second actuation signal; and a second actuator operable by means of a second power source and activatable by means of the second actuation signal from the transducer to open the valve in the central through-bore in the LHRT.

13. A Liner hanger assembly (LHA), comprising:

the LHRT of claim 1; and the linger hanger (LH) connected to the LHRT, wherein the LH comprises a setting port, a setting piston, and an anchor, wherein the setting piston is configured to be operated by hydraulic pressure through the setting port to set the anchor inside a casing in a well.

14. The LHA of claim 13, wherein the LHRT is provided with a pair of seals straddling the setting port on the LH prior to activating the actuator, thereby preventing unintentional setting of the LH.

15. The LHRT of claim 1, wherein the actuator is disposed in a cavity within the mandrel of the LHRT.

16. A liner hanger running tool (LHRT) having a mandrel with a central through-bore, the LHRT comprising:

a transducer configured to identify a predetermined activation signal and, based on receipt of the predetermined activation signal, transmit an actuation signal;

a power source;

a valve;

an actuator configured to be operated by the power source and activated by the actuation signal from the transducer to close the valve in the central through-bore in the mandrel; and a setting sleeve disposed outside the mandrel, wherein the setting sleeve is linearly movable relative to the mandrel in response to pressure in the central through-bore of the LHRT;

wherein the valve is a ball valve mechanically coupled to the setting sleeve, whereby moving the setting sleeve in a first direction closes the valve;

wherein activation of the actuator is configured to open a radial bore in the mandrel hydraulically coupling the setting sleeve and the central through-bore so that one side of a shoulder on the setting sleeve is exposed to the hydraulic pressure in the through-bore;

wherein the LHRT is provided with a first burst disc placed in an additional radial bore to provide a hydraulic connection between the central through-bore and the shoulder on the setting sleeve.

17. The LHRT of claim 16, wherein the LHRT is provided with a second burst disc placed in an additional radial bore to provide a hydraulic connection between the central through-bore and the a second shoulder on the setting sleeve.

18. A method for installing a liner hanger (LH) with a liner hanger running tool (LHRT) having a mandrel with a central through-bore, the method comprising:

coupling the LHRT to a liner, wherein the LHRT comprises:

a first transducer configured to identify a first predetermined activation signal and, based on receipt of the first predetermined activation signal, transmit a first actuation signal;

a first power source;

a valve, wherein the valve is a ball valve mechanically coupled to the setting sleeve, whereby moving the setting sleeve in a first direction closes the valve;

a first actuator configured to be operated by the first power source and activated by the actuation signal from the transducer to close the valve in the central through-bore in the mandrel;

a setting sleeve disposed outside the mandrel, wherein the setting sleeve is linearly movable relative to the mandrel in response to pressure in the central through-bore of the LHRT;

wherein activation of the first actuator is configured to open a first radial bore in the mandrel hydraulically coupling the setting sleeve and the central through-bore so that one side of a first shoulder on the setting sleeve with a first contact area is exposed to the hydraulic pressure in the through-bore;

a second transducer configured to identify a second predetermined activation signal and, based on receipt of the second predetermined activation signal, transmit a second actuation signal; and a second actuator operable by a second power source and activatable by the second actuation signal from the transducer to open the valve in the central through-bore in the LHRT;

wherein activation of the second actuator opens a second radial bore in the mandrel hydraulically connecting the setting sleeve and the central through-bore so that one side of a second shoulder on the setting sleeve is also exposed to the hydraulic pressure in the through-bore, the second shoulder having a second contact area that is larger than the first contact area of the first shoulder;

running the liner with the LHRT into a well on a pipe string, wherein the pipe string is in fluid communication with the through-bore of the LHRT;

positioning the LH inside a casing to which it is to be coupled;

transmitting the first predetermined activation signal to the first transducer to activate closing of the valve with the first actuator;

increasing the pressure in the pipe string above the closed valve;

exposing a setting piston on the LH to the pressure in the pipe string through a setting port to set the anchor inside the casing and thereby connect the LH to the inside of the casing.

19. The method of claim 18, the method comprising:

verifying that the LH has been set by controlling the weight on the pipe string.

20. The method of claim 19, the method comprising:

further increasing the pressure in the pipe string to release the LHRT from the LH.

21. The method of claim 18, the method comprising:

further increasing the pressure in the pipe string to release the LHRT from the LH.

22. The method according to claim 21, wherein the method further comprises:

transmitting the second predetermined activation signal to the second transducer to activate opening of the valve by means of the second actuator.

23. A liner hanger running tool (LHRT) for running a liner hanger (LH) into a well and setting the LH in the well, the LHRT comprising:

a mandrel with a central through-bore;

a valve disposed along the central through-bore of the mandrel, wherein the valve has an open position configured to allow a flow of a fluid through the central through-bore of the mandrel and a closed position configured to prevent the flow of the fluid through the mandrel;

a transducer disposed along the mandrel and configured to identify a predetermined activation signal and, based on receipt of the predetermined activation signal, transmit an actuation signal;

an actuator disposed along the mandrel and configured to be activated by the actuation signal from the transducer to transition the valve from the open position to the closed position;

wherein the LHRT includes:

a running position configured to lower the LH into the well with the mandrel, the valve, the transducer, and the actuator disposed within the LH; and a setting position configured to transition the valve from the open position to the closed position and set the LH in the well with the mandrel, the valve, the transducer, and the actuator disposed within the LH.

* * * * *